United States Patent [19]

Densen

[11] Patent Number: 4,830,080

[45] Date of Patent: May 16, 1989

[54] KNOCKDOWN FOLDING SCREEN

[76] Inventor: Mark S. Densen, 18 Blackburn Pl., Summit, N.J. 07901

[21] Appl. No.: 177,400

[22] Filed: Apr. 4, 1988

[51] Int. Cl.[4] ..... A47G 5/00

[52] U.S. Cl. ..... 160/135; 160/351; 52/825

[58] Field of Search ..... 160/351, 135, 229.1, 160/377, 228, 231.2; 49/501; 52/825; 16/225, DIG. 13, 270, 271, 382

[56] References Cited

U.S. PATENT DOCUMENTS

| | | | |
|---|---|---|---|
| 2,268,669 | 1/1942 | Moore | 160/229.1 |
| 2,595,848 | 5/1950 | Barlow | 160/229.1 |
| 3,032,808 | 5/1962 | Fleming | 16/382 X |
| 3,662,807 | 5/1972 | Miller | 160/135 |
| 4,296,524 | 10/1981 | Horholt et al. | 16/225 |
| 4,409,758 | 10/1983 | Dickerson et al. | 160/231.2 X |
| 4,443,911 | 4/1984 | Bannister | 160/135 X |
| 4,467,854 | 8/1984 | Godfrey | 160/135 |
| 4,563,381 | 1/1986 | Woodland | 16/225 X |

*Primary Examiner*—Blair M. Johnson

*Attorney, Agent, or Firm*—Arthur T. Fattibene

[57] ABSTRACT

A relatively inexpensive knockdown foldable screen that includes a plurality of panels having a pair of upright frame members for receiving and fixedly securing therebetween an inexpensive panel board, and a hinge construction that includes a pair of longitudinally extending gripping channels interconnected by a flexible hinge or web integrally formed therebetween, whereby the respective gripping channels received and frictionally retain the upright frame member of a panel for hingedly connecting adjacent pairs of similarly constructed panels. The top and bottom of the panel board between the upright frame members are fitted with a similarly connected frame member to complete the screen assembly.

7 Claims, 2 Drawing Sheets

KNOCKDOWN FOLDING SCREEN

FIELD OF INVENTION

This invention relates to a relatively inexpensively constructed folding screen or room divider which can be readily assembled and disassembled without the use of any tools.

PROBLEM AND PRIOR ART

Folding screens and/or room dividers are generally well known, and have been made by various constructions. Generally, the known folding screen and/or room dividers that are readily available are relatively expensive and generally permanently constructed. That is, that once assembled, the folding screen and/or room divider is not intended to be readily disassembled. Also, the available known screens are heavy and being preassembled, increase the problem of shipment and/or storage thereof.

OBJECTS

An object of this invention is to provide for a relatively simple and inexpensively constructed folding screen which can be readily assembled and disassembled by ultimate users.

Another object is to provide a relatively inexpensive screen which is completely formed of prefabricated parts which can be readily assembled and disassembled by the ultimate user or consumer without the need of any tools.

Another object is to provide a folding screen or room divider which can be readily assembled and disassembled between an erected position and a knockdown position.

Another object is to provide a folding screen construction made from a minimum of component parts which are essentially similar in construction.

Another object is to provide a folding screen or room divider having similarly constructed panels which can be readily coupled together to define a folding screen having any number of panels serially connected to one another.

Another object of this invention is to provide for an integrally formed hinge assembly for detachably connecting or coupling together adjacent pairs of panels.

Another object is to provide a folding screen or room divider comprised of similarly constructed frame members extruded of plastic material in accordance with a specific shape for frictionally retaining therein an inexpensive cardboard panel.

SUMMARY OF THE INVENTION

The foregoing objects and other features and advantages of this invention are attached by a folding screen or room divider having a series of panels hingedly connected to one another. Each of the panels are similarly constructed and include a pair of upright frame members preferably formed of an extruded plastic. The extruded frame members are formed as a hollow structure with a longitudinally extending internal groove formed along one end thereof and a pair of opposed rail grooves formed externally thereof adjacent the other longitudinal end thereof. The internal groove is provided with opposed integrally connected gripper teeth. A panel board, preferably formed of an inexpensive material, such as cardborad or the like, is frictionally retained with the grooves of opposed upright frame members.

An upper and lower cross piece of a similarly constructed extruded part is fitted to the upper and lower edges of the panel board between the upright frame members to complete the panel construction. A pair of such constructed panels are coupled or hingedly connected by a hinge assembly that includes a pair of oppositely disposed channel members which are interconnected by a flexible web or hinge. The open end of the respective channels are provided with inturned lip portions which are adapted to engage or snap fit onto the rail grooves of the upright members of adjacent panels to cuple them together. The arrangment is such that any number of like panels can be detachably connected in series. An end cap may be provided to close the upper end of the respective upright frame members.

FEATURES

A feature of this invention resides in the provision that the screen panel is composed of similarly constructed extruded frame members between which an inexpensive panel board is frictionally retained.

Another feature resides in the provision of a novel constructed hing assembly comprised of opposed gripping channel members interconnected by a flexible hinge which can be readily molded.

Another feature resides in the provision of a folding screen which can be readily packaged in its knockdown or disassembled position to define a package of minimum weight and size.

Another feature resides in the provision of a knockdown screen or room divider having few component parts that can be readily assembled or disassembled by the ultimate user or consumer without the need of any tools or extraneous fasteners.

Another feature resides in the provision of a folding screen or room divider which is relatively light in weight, inexpensive to manufacture, easy to assemble or disassemble, rugged in use and positive in operation.

Other features and advantages will become more readily apparent when considered in view of the drawings and following specifications in which.

DETAIL DESCRIPTION

Figure 1:
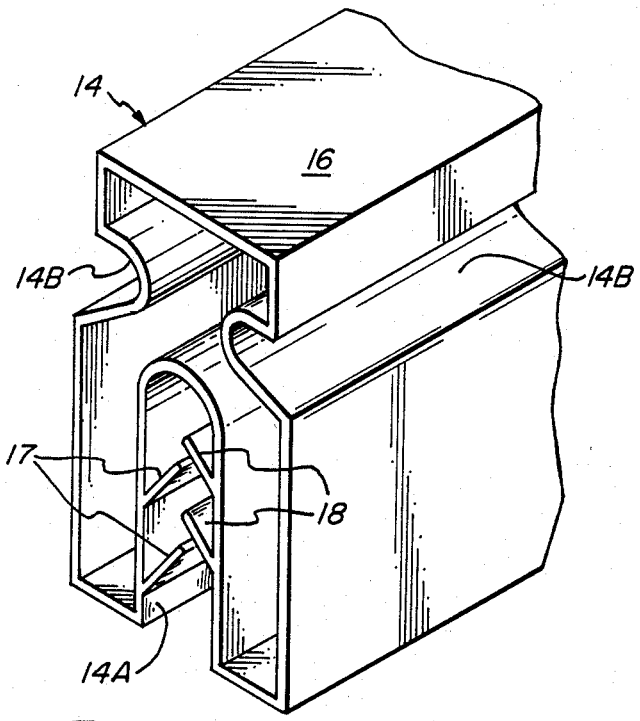
FIG. 1 is a perspective detail view of a fragmentary portion of a frame member embodied in the room divider of the present invention.
Figure 2:
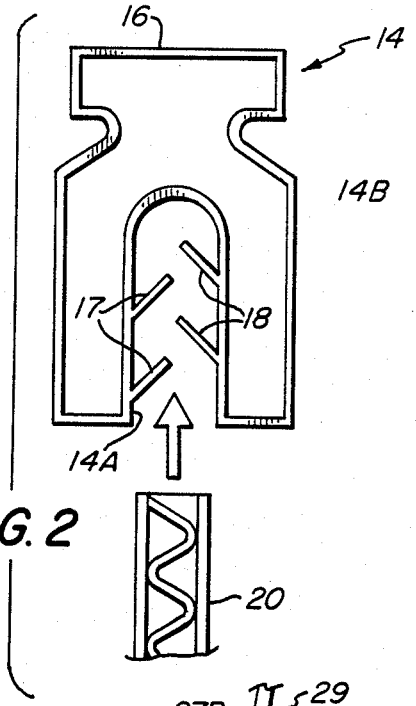
FIG. 2 is an exploded detail end view illustrating a detail of assembly.

Referring to the drawings, there is shown in FIG. 1 a folding screen or room divider 10 comprising a plurality of panels 11, 12 and 13. While the illustrated embodiment is made up of three hingedly connected panels, 11, 12 and 13, it will be apparent that the screen may include two or more panels; and as will be hereinafter apparent, panels can be readily added to the screen to define any desired size or length of screen. Each of the panels 11, 12 and 13 are similarly constructed. As best seen in FIG. 2, each panel includes a pair of oppositely disposed upright frame members 14—14 of a predetermined length. Each of the respective frame members 14—14 are of like construction.

Figure 3:
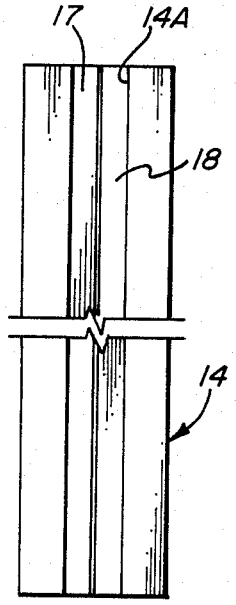
FIG. 3 is a longitudinally extending end view of the frame member illustrated in FIGS. 1 and 2.

Referring to FIG. 3, the upright frame members 14—14 comprise an extruded member having a cross sectional shape as shown. Preferably, the frame members 14—14 are formed of an extruded pastic member which may comprise either a hollow or solid structure. The frame members 14—14 include an elongated length which is formed with an internal groove 14A—14A extending along the inner end thereof, and a pair of external track grooves 14B, 14B extending along the opposed sides of the frame member 14 adjacent the other longitudinal edge 16 thereof. Formed within the groove and extending inwardly thereof from the opposed walls of the groove 14A are a series of retaining means which comprise an integrally formed pincher or pinching teeth 17, 18. As shown in FIG. 3, the pincher teeth 17, 18 comprise a web extending along the length of the groove which is angularly disposed relative to the walls of the groove. Preferably, the teeth or web 17 along one wall of the groove 14A are staggered relative to the teeth or web 18 formed on the other wall of the groove.

In accordance with this invention, a panel board, preferably a sheet of corrugated cardboard or fiberboard 20 is connected to and between the respective upright frame members 14—14 by inserting the edge portions of the panel board 20 into the groove of the frame member 14—14. The insertion of the board 20 in the groove 14A will be lockingly gripped by the retaining teeth 17 and 18. The retaining teeth 17 and 18 are preferably integrally molded of the material from which the frame member 14 is formed, and thus would tend to have sufficient flexibility to permit insertion of the board; and the angle of the teeth is such so as to resist separation between the panel board 20 and the associated frame member 14—14.

Completing the panel assembly are upper and lower cross-members 22, 23 having a similar construction as described with respect to upright 14—14. As noted in FIGS. 1 and 2, the upper and lower cross piece members 22, 23 are fitted to the upper and lower edges of the panel board 20 respectively. If desired, an end piece or cap 24 may be fitted to the upper end of the frame members 14—14. As noted in FIG. 1, the length of the panel boards 20 is slightly less than the length of the frame member 14—14 whereby the difference therebetween defines feet portions 25 for the assembled screen. From the foregoing, it will be noted that each panel 11, 12 and 13 of the screen are similar in construction wherein the respective frame members 14—14, 22 and 23 are all made from a common extruded piece cut to suitable length, and pressure or snap fitted to the respective edges of the panel board 20. Thus, assembly of the respective panels 11, 12 and 13 can be readily assembled without the use of any tools; when the panel board 20 and the respective frame members 14—14, 22 and 23 have all been pre-cut to a desired size; simply by press fitting the frame member of a corresponding edge of a panel board.

In accordance with this invention, a novel hinge assembly is provided for coupling together adjacent panels, e.g., panels 11 and 12 or 12 and 13.

Figure 4:
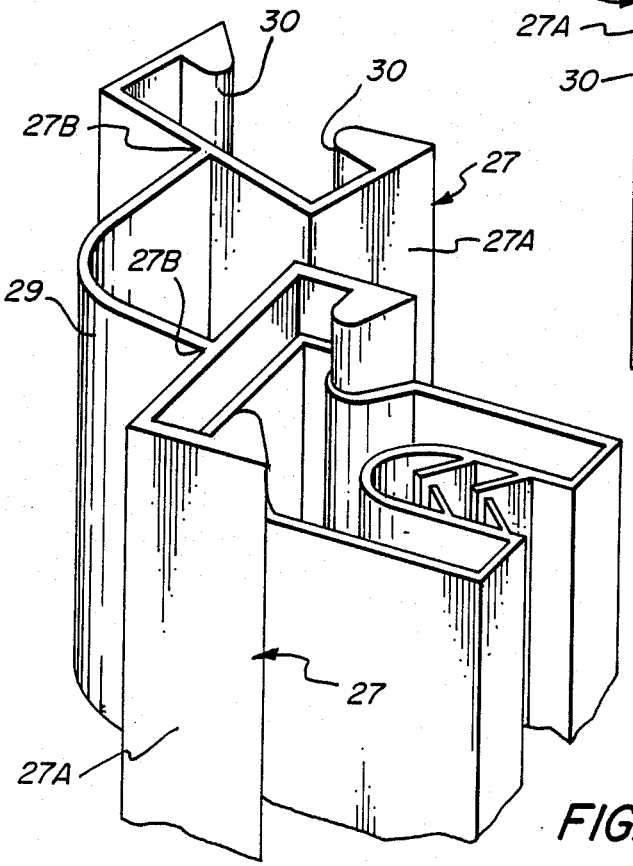
FIG. 4 is a perspective detail view illustrating the hinge connection embodied in the room divider of the present invention.
Figure 5:
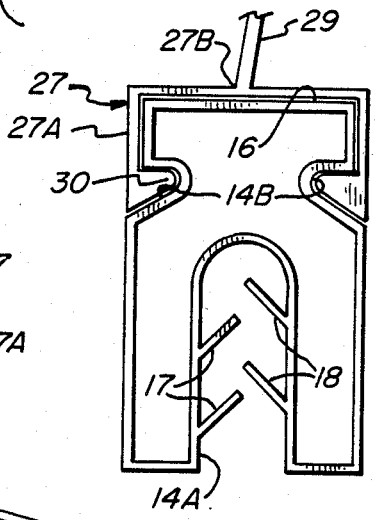
FIG. 5 is an end view of a detail of construction illustrating the connection between the hinging member and the frame member of the folding screen or room divider embodying the present invention.
Figure 6:
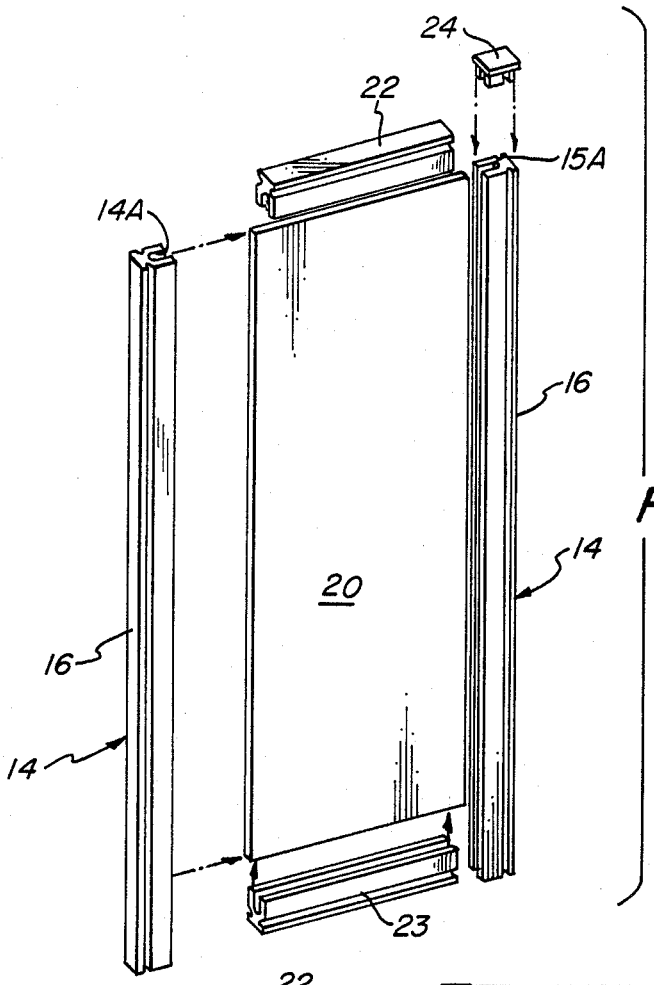
FIG. 6 is an exploded perspective view of a panel section of the folding screen or room divider embodying the present invention.
Figure 7:
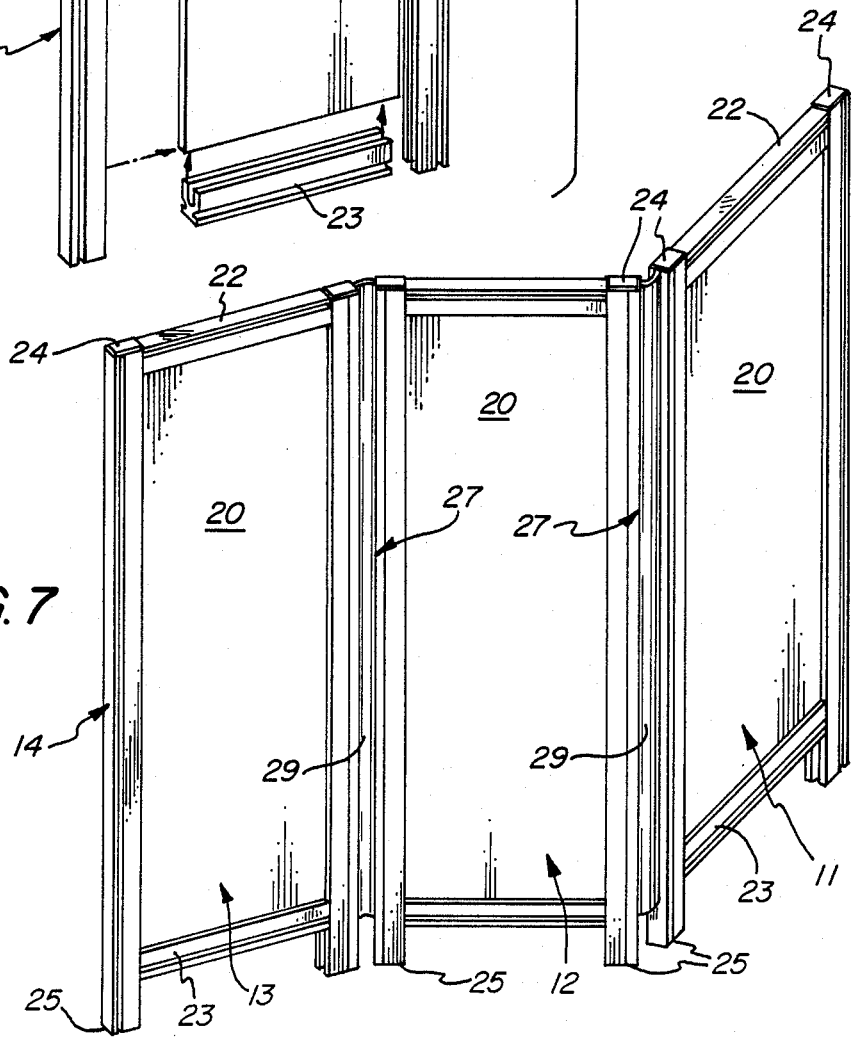
FIG. 7 is a perspective view of a folding screen or room divider embodying the instant invention.

Referring to FIG. 4, the hinge assembly 26 comprises a pair of oppositely disposed gripper channel 27—27, which are of identical construction. Each gripper channel 27—27 is generally U-shaped in cross section having opposed leg portions 27A—27A interconnected by a bight portion 27B. Disposed between the respective bight portion 28—28, and connected thereto, is a flexible web or hinge 29 that extends along the length of the gripper channel 27. Preferably, the gripper channels 27—27 and the interconnecting hinge web 29 may be integrally molded of a suitable plastic. The free ends of the respective leg portions 27A, 27A of the gripper channels are provided with an inturned lip portion 30—30.

To couple or hingedly connect a pair of panel assemblies, e.g., 11 and 12, the gripper channel 27 is snap fitted or guided along the length of the upright frame member 14 as indicated in FIG. 4. Thus, by connecting one frame member of adjacent pairs or panels to the respective gripper channels 27 of the hinge assembly 26, the coupled panels are free to pivot relative to one another. A third and succeeding number of panels can be added by interposing another hinge assembly between each pair of connected adjacent panels. Thus, the number of hinge assemblies required for any given size screen will be one less than the number of panels.

From the foregoing, it will be apparent that the entire screen is composed of a relatively inexpensive panel board, e.g., cardboard, fiberboard and the like, which is suitably framed by rigid structural frame members which are pre-cut form a common shaped structural member, and which panels so formed can be readily hinged or coupled in a foldable manner by an integrally constructed hinge assembly that can be frictionally or snap fitted to the upright frame member of a given panel. No tools are required for the assembly and/or disassembly. The arrangement is such that the edges of the panel board are frictionally secured within the groove of the respective frame members without the need of any extraneous fasteners. The respective component can be readily shipped or stored in a minimum sized package; whereby assembly can be readily effected by the end user in a simple and expedient manner, and without the use of any tools. The assembly screen is rigid, rugged and light in weight. It will be understood that the panel can be imprinted with or provided with suitable decorative design.

Essentially, the entire screen assembly consists of similarly constructed panels framed by a similarly constructed frame member and hinged or coupled together by an integral hinge assembly.

While the invention has been described with respect to a particular embodiment, it will be understood that variations and modifications can be made without departing from the spirit or scope of the invention.

What is claimed is:

1. A folding screen comprising a plurality of folding panels, each of said panels including a pair of opposed elongated upright rigid frame members having a length and a width when viewed in crosssection and each of said frame members having an internal groove extending longitudinally along a longitudinal edge thereof whereby the internal grooves of said pair of frame members are opposed, said internal groove extending into the upright frame member in a direction along the crosssectional length thereof, a panel plurality of panel boards each having opposed edges retained within the opposed internal grooves of said frame members, a hinge assembly hingedly connecting adjacent pairs of said folding panels, said hinge assembly including a pair of longitudinally extending gripping members, a flexible web interconnected between said gripping members, each of said gripping members including a channel shaped member detachably receiving a frame member of a folding panel whereby the longitudinal edge of said panel board is spacially disposed relative to said gripping member in a direction along said crosssectional length of said frame member.

2. A folding screen as defined in claim 1 wherein each of said panel boards comprises a sheet of cardboard.

3. A folding screen as defined in claim 1, wherein said channel shaped members include opposed leg portions having oppositely disposed inturned lip portions, and said upright frame members having a track groove extending along the opposite sides thereof whereby the inturned lip portions of said channel shaped member engage said track grooves in the assembled position of said screen.

4. A folding screen as defined in claim 1 and including a cross member, wherein said cross member and said upright frame members are similarly constructed in cross-section.

5. A folding screen as defined in claim 1, and including means for frictionally retaining the longitudinal edges of said panel board within said internal groove, said frictional means including oppositely disposed teeth formed on opposite sides of said groove for gripping therebetween the longitudinal edges of said panel board disposed between said pair of frame members.

6. A relatively inexpensive folding screen comprising at least a pair of panels, each of said panels including a pair of spaced apart, opposed elongate upright frame members, each of said upright frame members having a length and a width when viewed in crosssection and further having an internal groove formed along a longitudinal edge thereof said internal groove extending into the upright frame member along the crosssectional length thereof, retaining means integrally formed on walls of said internal grooves, said retaining means including opposed inwardly projecting teeth, and said upright frame members each including a pair of opposed external track grooves extending longitudinally thereof, at least one pair of panel boards having opposed longitudinal edge portions, said edge portions of said panel boards being frictionally secured within the internal grooves of said upright frame members, a hinge assembly for coupling adjacent pairs of said panels, said hinge assembly including a pair of opposed gripper channels, each of said grippers channels including a pair of opposed leg portions and an interconnected bight portion, an inturned lip formed on the free ends of said opposed leg portions, and a flexible web connecting to the bight portion of said opposed gripper channels, and said gripper channels being connected to the adjacent upright frame members of a pair of adjacent panels whereby the inturned lip of said gripper channels engage the opposed track grooves of the corresponding frame member and a longitudinal edges of said panel boards being spaced from said opposed leg portions of said gripper channels in a direction along said crosssectional length of said upright frame members

7. A folding screen as defined in claim 6 and including an upper and lower cross piece frame member, each of said upper and lower cross piece frame members having an internal groove and retaining means similar to that of said upright frame members, and said cross piece frame members being frictionally secured to upper and lower edge portions of said panel boards and an end cap closing an upper end of said upright frame members.

* * * * *